US009457950B2

(12) United States Patent
Yoshinori

(10) Patent No.: US 9,457,950 B2
(45) Date of Patent: Oct. 4, 2016

(54) TABLET CASSETTE

(75) Inventor: Kenzo Yoshinori, Hirakata (JP)

(73) Assignee: TAKAZONO TECHNOLOGY INCORPORATED, Hirakata-shi (JP)

( * ) Notice: Subject to any disclaimer, the term of this patent is extended or adjusted under 35 U.S.C. 154(b) by 264 days.

(21) Appl. No.: 13/996,326

(22) PCT Filed: Jan. 11, 2012

(86) PCT No.: PCT/JP2012/050358

§ 371 (c)(1),
(2), (4) Date: Jun. 20, 2013

(87) PCT Pub. No.: WO2012/105286

PCT Pub. Date: Aug. 9, 2012

(65) Prior Publication Data

US 2014/0084020 A1 Mar. 27, 2014

(30) Foreign Application Priority Data

Feb. 1, 2011 (JP) ..... 2011-019676

(51) Int. Cl.
*B65D 83/04* (2006.01)
*G07F 11/00* (2006.01)
(Continued)

(52) U.S. Cl.
CPC ..... *B65D 83/0409* (2013.01); *G07F 11/005* (2013.01); *G07F 11/44* (2013.01); *G07F 17/0092* (2013.01); *G07F 11/24* (2013.01)

(58) Field of Classification Search
CPC .. A61J 1/03; A61J 7/0076; A61J 2007/0427; B65B 1/16; B65D 83/00; B65D 83/04; B65D 83/0409; G07F 17/0092
USPC ..... 221/82, 209, 277
See application file for complete search history.

(56) References Cited

U.S. PATENT DOCUMENTS 3,128,011 A * 4/1964 Bleiman ..... 221/68
5,803,309 A * 9/1998 Yuyama et al. ..... 221/82
(Continued)

FOREIGN PATENT DOCUMENTS

CN 1860062 A 11/2006
JP 50-143953 A 11/1975
(Continued)

OTHER PUBLICATIONS

International Search Report Dated Apr. 24, 2012, Issued in Corresponding Application No. PCT/JP2012/050358.
(Continued)

*Primary Examiner* — Gene Crawford
*Assistant Examiner* — Kelvin L Randall, Jr.
(74) *Attorney, Agent, or Firm* — Westerman, Hattori, Daniels & Adrian, LLP

(57) ABSTRACT

When a tablet housed in a groove is transported below the cover portion, the tablet falls downward from the dispensing hole. A main body portion includes a first fulcrum which serves as a fulcrum for a movement in which a part of the cover portion, which is in contact with the tablet when the cover portion and the tablet begin to contact each other, moves as a result of being pressed by the tablet, and a second fulcrum which serves as a fulcrum for a movement in which the part of the cover portion, which is in contact with the tablet, moves as a result of being pressed by the tablet after the movement of the main body portion and an extending portion supported by the first fulcrum is finished.

4 Claims, 20 Drawing Sheets

(51) Int. Cl.

| | |
|---|---|
| ***G07F 11/44*** | (2006.01) |
| ***G07F 17/00*** | (2006.01) |
| *G07F 11/24* | (2006.01) |

(56) References Cited

U.S. PATENT DOCUMENTS

| | | | | |
|---|---|---|---|---|
| 6,287,385 | B1 | 9/2001 | Kroneberger | |
| 7,857,162 | B2 * | 12/2010 | Minami et al. | 221/82 |
| 8,616,409 | B2 * | 12/2013 | Young et al. | 221/167 |
| 2007/0116792 | A1 | 5/2007 | Yuyama et al. | |
| 2008/0029535 | A1 * | 2/2008 | Kim | 221/167 |
| 2008/0099499 | A1 * | 5/2008 | Kim | 221/82 |
| 2011/0042404 | A1 * | 2/2011 | Koike et al. | 221/2 |
| 2013/0062363 | A1 * | 3/2013 | Yuyama et al. | 221/82 |
| 2014/0183208 | A1 * | 7/2014 | Bae et al. | 221/91 |
| 2015/0027286 | A1 * | 1/2015 | Yuyama et al. | 83/105 |

FOREIGN PATENT DOCUMENTS

| | | | | | |
|---|---|---|---|---|---|
| JP | 54-92719 | U | | 6/1979 | |
| JP | 09-39910 | A | | 2/1997 | |
| JP | 09-266940 | A | | 10/1997 | |
| JP | 09266940 | A | * | 10/1997 | A61J 3/00 |
| JP | 2001-176955 | A | | 6/2001 | |

OTHER PUBLICATIONS

Chinese Office Action dated May 4, 2014, issued in Chinese Patent Application No. 201280007373.0 (5 pages).

* cited by examiner

TABLET CASSETTE

TECHNICAL FIELD

The present invention relates to a tablet cassette installed in a medicine supplying apparatus which is mainly disposed in a hospital or the like for appropriately selecting and then dispensing a medicine such as a tablet, a capsule or the like according to a prescription of each patient.

BACKGROUND ART

A conventional tablet cassette is disclosed, for example, in Japanese Patent Laying-Open No. 9-266940 (PTD 1).

CITATION LIST

Patent Document

PTD 1: Japanese Patent Laying-Open No. 9-266940

SUMMARY OF INVENTION

Technical Problem

The conventional tablet cassette has such a problem that when a tablet is transported while contacting a divider plate for guiding the tablet, it is very likely to have an excessive load applied to the tablet.

The present invention has been accomplished to solve the mentioned problem, and it is therefore an object to provide a tablet cassette capable of preventing an excessive load from being applied to a tablet.

Solution to Problem

The tablet cassette according to one aspect of the present invention includes a main body for housing a tablet; a delivering member disposed with a groove for receiving the tablet housed in the main body; and a divider member including an elastic portion mounted to the main body and a cover portion mounted to the elastic portion and configured to be able to cover at least a part of an opening portion of the groove. A hole is opened in the main body below the cover portion, which allows a tablet to fall downward from the hole in the main body when the tablet housed in the groove is transported below the cover portion. A tablet with a portion protruding from the groove is transported to the cover portion to have a contact therewith. The elastic portion includes a first fulcrum which serves as a fulcrum for a movement in which a part of the cover portion, which is in contact with the tablet when the cover portion and the tablet begin to contact each other, moves as a result of being pressed by the tablet, and a second fulcrum which serves as a fulcrum for a movement in which the part of the cover portion, which is in contact with the tablet, moves as a result of being pressed by the tablet after the movement of the elastic portion supported by the first fulcrum is finished.

Since the tablet cassette configured as mentioned above has two fulcrums, by changing the fulcrum in accordance with a position of a tablet, it is possible to shape the elastic portion with a small force, preventing an excessive load from being applied to the tablet.

Preferably, the first fulcrum is located downstream of flow of the tablet, relative to the second fulcrum.

Preferably, the elastic portion includes a first piece and a second piece extending respectively in a tablet transporting direction, the first piece is mounted to the main body at one end, the second piece is mounted to the cover portion, and the first piece and the second piece are connected to each other at the other end.

Preferably, the divider member is produced by bending a metal plate.

The tablet cassette according to another aspect of the present invention includes a main body for housing a tablet; a delivering member disposed with a groove for receiving the tablet housed in the main body; and a divider member including an elastic portion mounted to the main body and a cover portion mounted to the elastic portion and configured to be able to cover at least a part of an opening portion of the groove. A hole is opened in the main body below the cover portion, which allows a tablet to fall downward from the hole in the main body when the tablet housed in the groove is transported below the cover portion. A tablet with a portion protruding from the groove is transported to the cover portion to have a contact therewith. The elastic portion includes a first piece and a second piece extending respectively in a tablet transporting direction, the first piece is mounted to the main body at one end at a upstream side of the tablet flow, the second piece is mounted to the cover portion, and the first piece and the second piece are connected to each other at the other end at a downstream side of the tablet flow.

Since the tablet cassette configured as mentioned above is provided with the first piece and the second piece, even when the cover portion is pressed by the tablet, it is possible to make the cover rock at a fulcrum which is served by either the one end or the other end. And consequently, it is possible to deform the elastic portion with a small force, preventing an excessive load from being applied to the tablet.

BRIEF DESCRIPTION OF DRAWINGS

FIG. 20 is view illustrating the divider plate in a state where the tablet has passed through;

DESCRIPTION OF EMBODIMENTS

Figure 1:
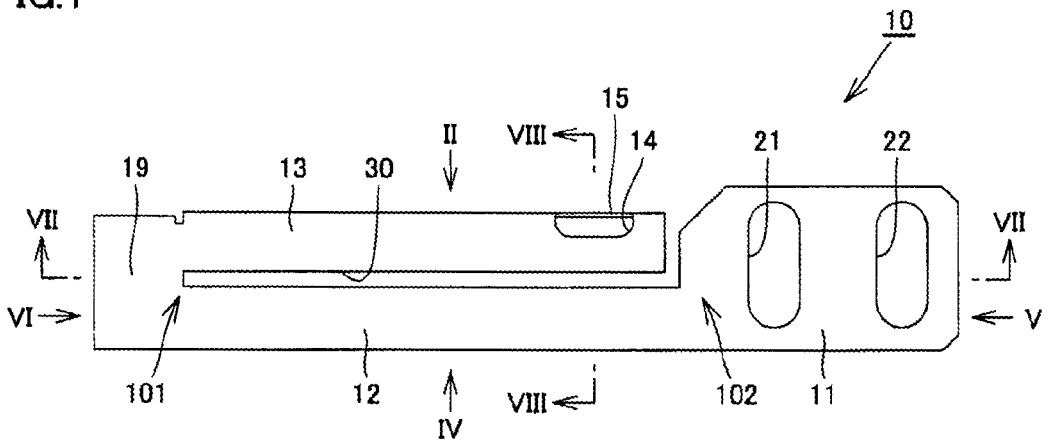
FIG. 1 is a front view of a divider plate used in a tablet cassette according to Embodiment 1 of the present invention.

Hereinafter, embodiments of the present invention will be described with reference to the drawings. The same or identical parts in the following embodiments will be assigned with the same reference numerals, and descriptions thereof will not be repeated. In addition, any combination of embodiments is acceptable.

Embodiment 1

Figure 2:
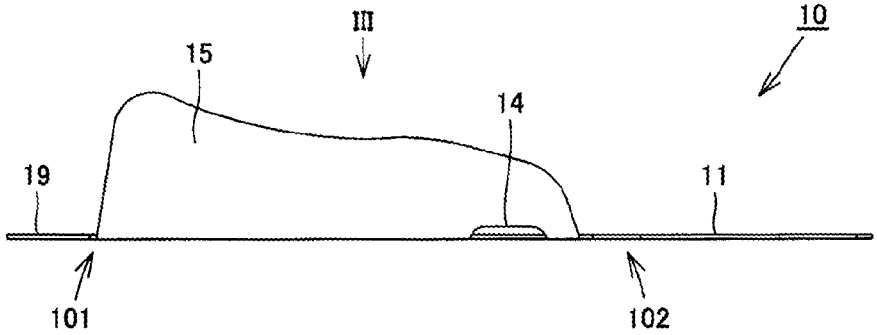
FIG. 2 is a plan view of the divider plate observed from the direction denoted by arrow II in FIG. 1.
Figure 3:
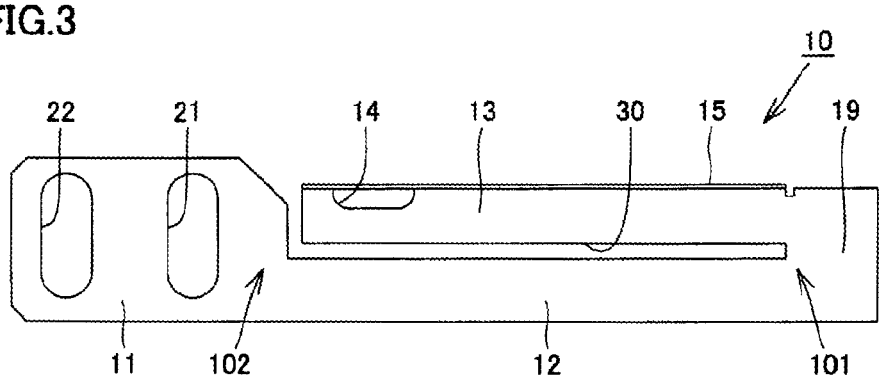
FIG. 3 is a back view of the divider plate observed from the direction denoted by arrow III in FIG. 2.
Figure 4:
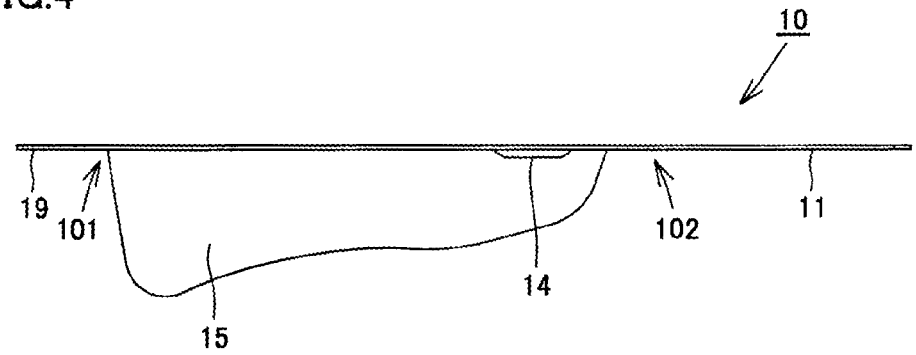
FIG. 4 is a bottom view of the divider plate observed from the direction denoted by arrow IV in FIG. 1.
Figure 5:
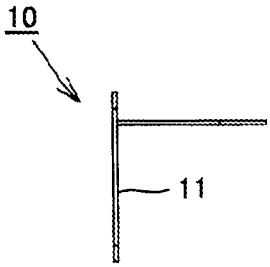
FIG. 5 is a right side view of the divider plate observed from the direction denoted by arrow V in FIG. 1.
Figure 6:
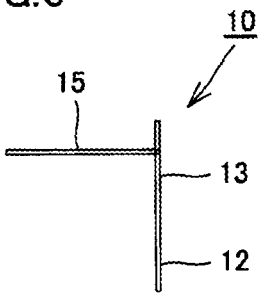
FIG. 6 is a left side view of the divider plate observed from the direction denoted by arrow VI in FIG. 1.
Figure 7:
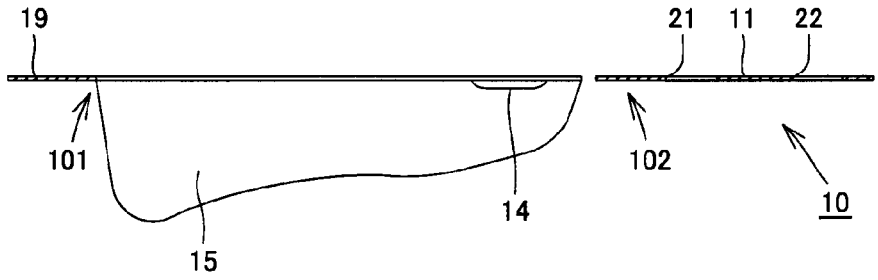
FIG. 7 is a cross sectional view along line VII-VII in FIG. 1.
Figure 8:
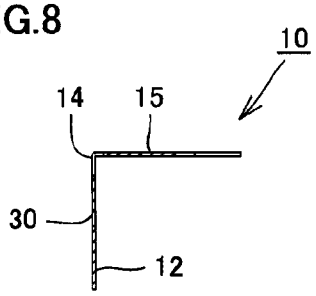
FIG. 8 is a cross sectional view along line VIII-VIII in FIG. 1.
Figure 9:
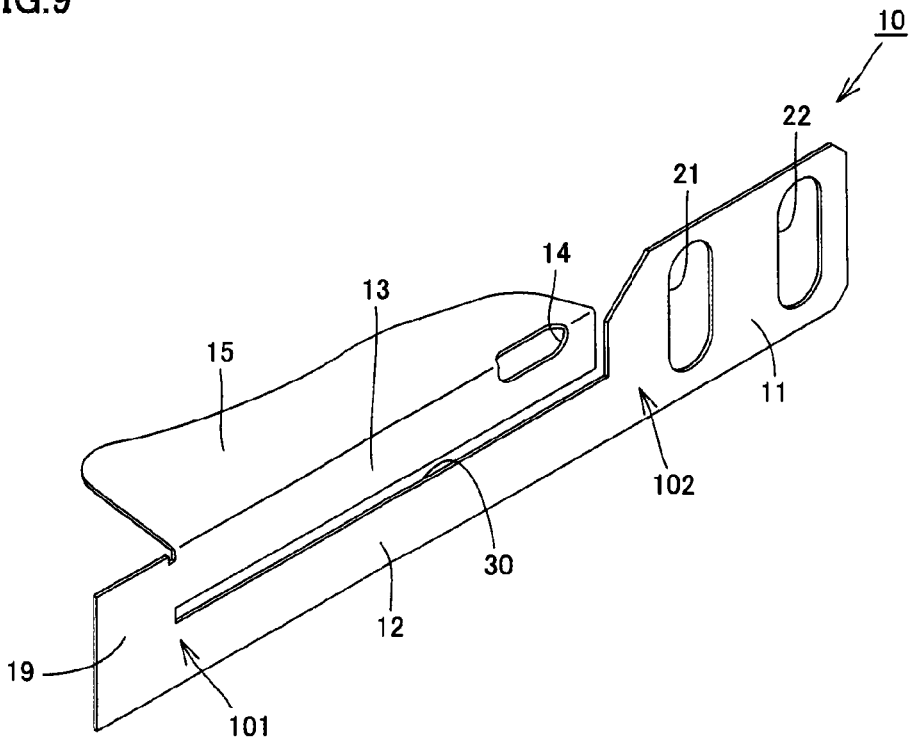
FIG. 9 is a perspective view of the divider plate illustrated in FIG. 1.

FIG. 1 is a front view of a divider plate used in a tablet cassette according to Embodiment 1 of the present invention. FIG. 2 is a plan view of the divider plate observed from the direction denoted by arrow II in FIG. 1. FIG. 3 is a back view of the divider plate observed from the direction denoted by arrow III in FIG. 2. FIG. 4 is a bottom view of the divider plate observed from the direction denoted by arrow IV in FIG. 1. FIG. 5 is a right side view of the divider plate observed from the direction denoted by arrow V in FIG. 1. FIG. 6 is a left side view of the divider plate observed from the direction denoted by arrow VI in FIG. 1. FIG. 7 is a cross sectional view along line VII-VII in FIG. 1. FIG. 8 is a cross sectional view along line VIII-VIII in FIG. 1. FIG. 9 is a perspective view of the divider plate illustrated in FIG. 1.

With reference to FIGS. 1 through 9, divider plate 10 used in the tablet cassette according to Embodiment 1 includes a mounting portion 11 mounted in the tablet cassette, a main body portion 12 connected to mounting portion 11, an extending portion 13 which extends in parallel to main body portion 12, a connecting portion 19 which connects main body portion 12 and extending portion 13 together, and a cover portion 15 provided in extending portion 13. Mounting portion 11 is provided with two holes 21 and 22. Both of the two holes 21 and 22 possess a long-hole shape which allows the position of divider plate 10 to change relative to the tablet cassette.

A portion close to the boundary between main body portion 12 and mounting portion 11 serves as a second fulcrum 102. Main body portion 12 can have a rocking movement about second fulcrum 102. When main body portion 12 rocks, extending portion 13 which is connected to main body portion 12 rocks together with main body portion 12.

A portion close to connecting portion 19 which connects main body portion 12 and extending portion 13 together serves as a first fulcrum 101. Extending portion 13 can have a rocking movement about first fulcrum 101. A slit 30 is disposed between main body portion 12 and extending portion 13. Increasing the length of slit 30 decreases the length of connecting portion 19. The length of connecting portion 19 in the direction of the slit affects the rocking movement of extending portion 13 about first fulcrum 101; thereby, if the length of connecting portion 19 in the direction of slit 30 increases, the strength of connecting portion 19 becomes greater, which in turn makes it difficult for extending portion 13 to rock about first fulcrum 101.

A window 14 functions as a window for observing the position of a transported tablet (including a capsule), and divider plate 10 is mounted at an optimum position with respect to the position of the tablet transported by a rotor.

Cover portion 15 is formed into the shape of a plate, and an edge which contacts the tablet to be transported from the side of mounting portion 11 is curved so as to allow the tablet to move smoothly. In the example illustrated in FIG. 2, the edge is formed into such a shape that a greater mountain is present at the side of first fulcrum 101 and a smaller mountain is present at the side of second fulcrum 102.

Figure 10:
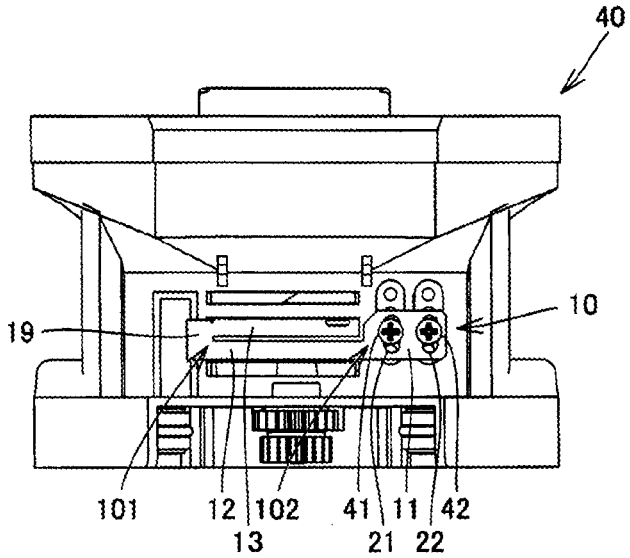
FIG. 10 is a front view of the tablet cassette according to Embodiment 1.
Figure 11:
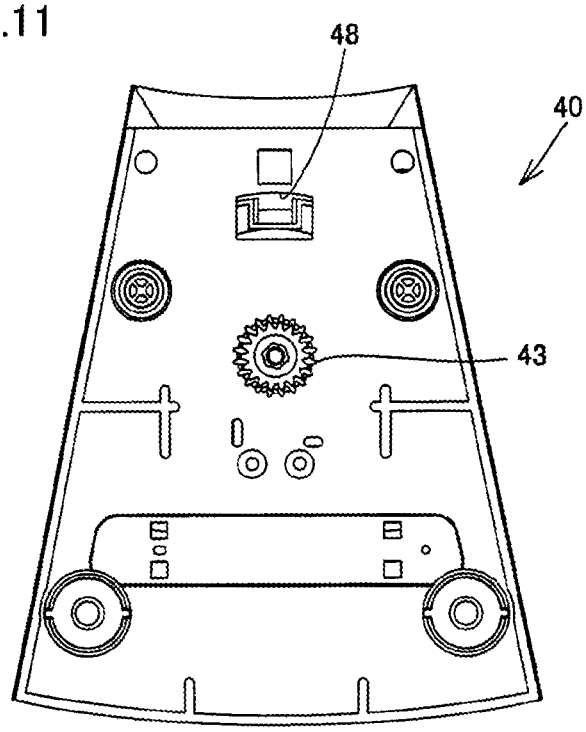
FIG. 11 is a bottom view of the tablet cassette illustrated in FIG. 10.
Figure 12:
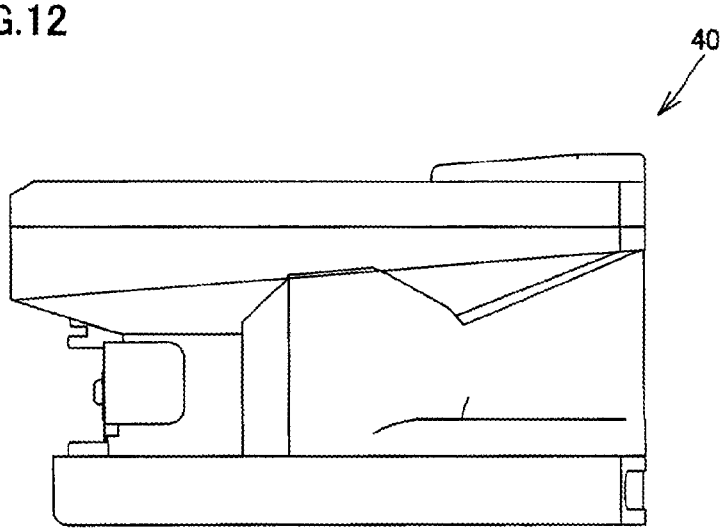
FIG. 12 is a right side view of the tablet cassette illustrated in FIG. 10.

FIG. 10 is a front view of the tablet cassette according to Embodiment 1. FIG. 11 is a bottom view of the tablet cassette illustrated in FIG. 10, and FIG. 12 is a right side view of the tablet cassette illustrated in FIG. 10. With reference to FIGS. 10 through 12, divider plate 10 is mounted to the front of tablet cassette 40 through screws 41 and 42. Holes 21 and 22 possess a long-hole shape which allows the mounting position of divider plate 10 to change in the vertical direction illustrated in FIG. 10. Thereby, the mounting position of divider plate 10 can be changed in accordance with the types (sizes) of tablets housed in tablet cassette 40.

Tablet cassette 40 is disposed with a gear 43 configured to rotate the rotor. Gear 43 is driven externally.

Figure 13:
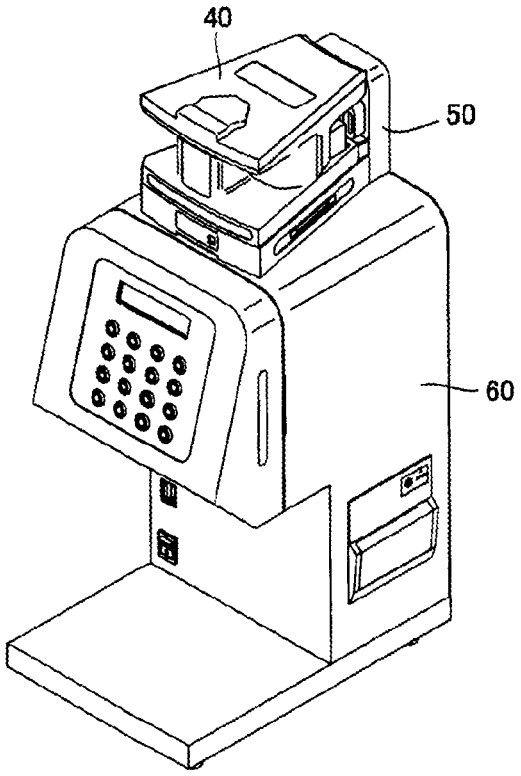
FIG. 13 is a perspective view illustrating a tablet counter used in the tablet cassette according to the present invention.

FIG. 13 is a perspective view illustrated a tablet counter used in the tablet cassette according to the present invention. With reference to FIG. 13, tablet cassette 40 and a cassette base 50 are disposed on tablet counter 60. Tablets housed in tablet cassette 40 are transported to tablet counter 60 through the intermediary of cassette base 50 and the number of tablets is counted in tablet counter 60.

In the present example, tablet cassette 40 is described as being mounted on tablet counter 60 but not limited thereto; it is acceptable that tablet cassette 40 and counter base 50 are mounted on a packaging machine.

Figure 14:
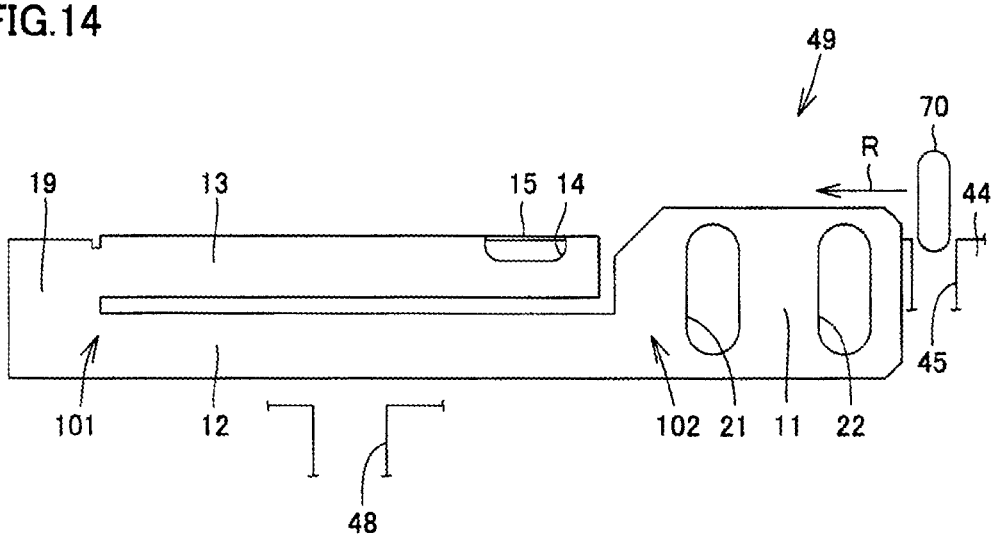
FIG. 14 is a front view illustrating a movement of a tablet moving inside the tablet cassette.
Figure 15:
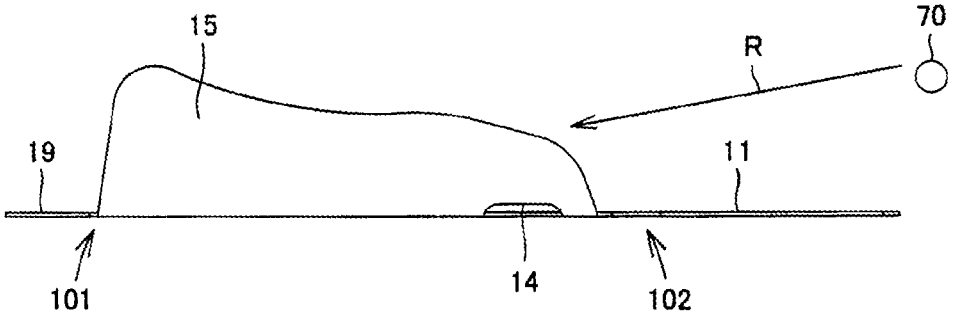
FIG. 15 is a plan view illustrating the movement of the tablet moving inside the tablet cassette.

FIG. 14 is a front view illustrating a movement of a tablet moving inside the tablet cassette, and FIG. 15 is a plan view illustrating the movement of the tablet moving inside the tablet cassette. With reference to FIGS. 14 and 15, when rotor 44 in tablet cassette 40 is rotated, tablet 70 is dispensed from a dispensing hole 48. A groove 45 is provided in rotor 44, and thus tablet 70 fitting with groove 45 passes through the lower side of cover portion 15 and is dispensed from dispensing hole 48. However, as illustrated in FIGS. 14 and 15, when a part of tablet 70 protrudes upward from groove 45, the tablet is transported by rotor 44 in the direction illustrated by arrow R to have a contact with cover portion 15.

Figure 16:
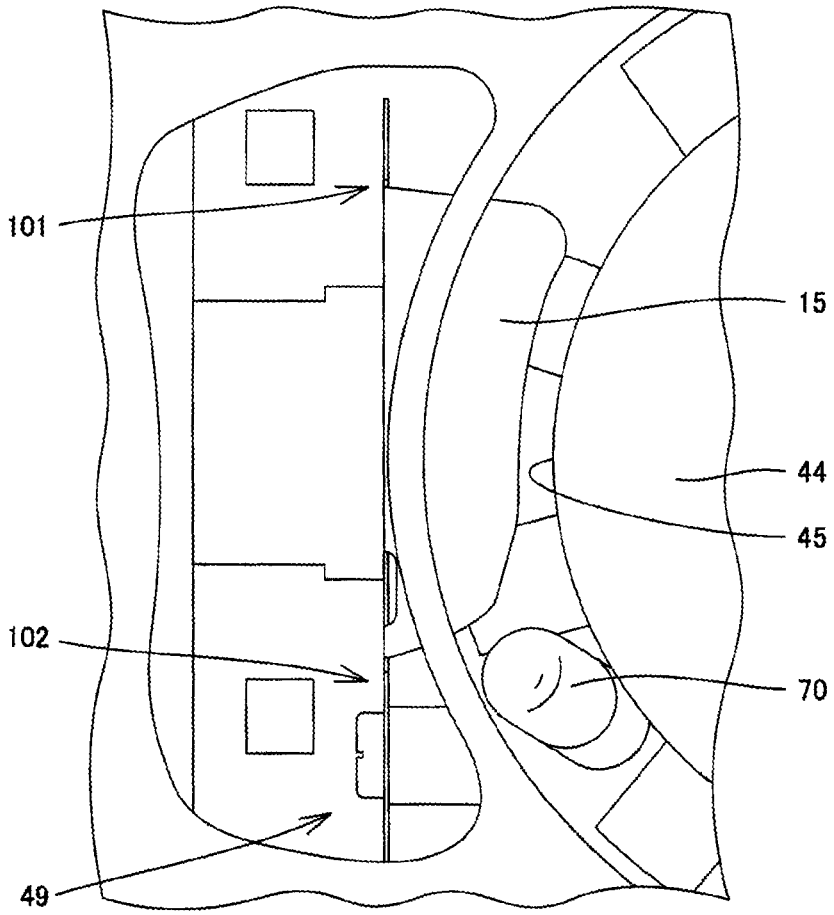
FIG. 16 is a view illustrating the divider plate immediately prior to contacting the tablet.

FIG. 16 is a view illustrating the divider plate immediately prior to contacting the tablet. With reference to FIG. 16, tablet 70 may be disposed as protruding from groove 45. In this case, if tablet 70 is transported by rotor 44, tablet 70 approaches cover portion 15.

Figure 17:
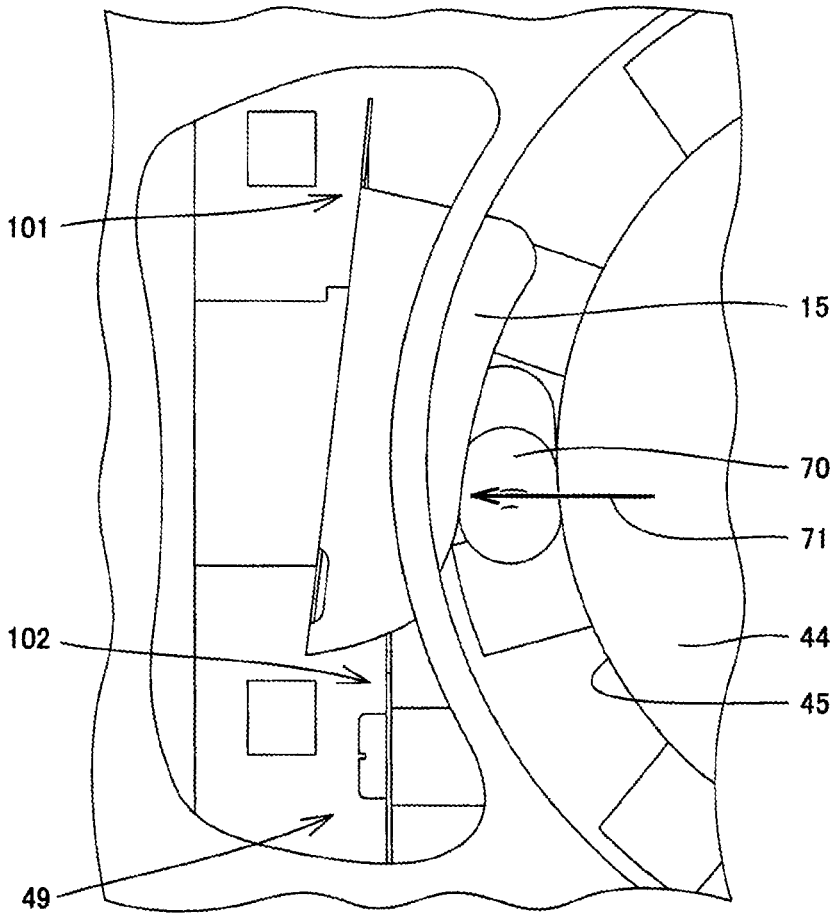
FIG. 17 is a view illustrating the divider plate in a state where the tablet begins to contact a cover portion.

FIG. 17 is a view illustrating the divider plate in a state where the tablet begins to contact the cover portion. With reference to FIG. 17, when tablet 70 contacts cover portion 15, tablet 70 applies a force to cover portion 15 in the direction illustrated by an arrow 71. In response to the force, cover portion 15 rocks about first fulcrum 101. As a result thereof, the position of cover portion 15 changes from the position as illustrated in FIG. 16 to increase a clearance between rotor 44 and cover portion 15, which thereby allows tablet 70 to be further transported by rotor 44.

Figure 18:
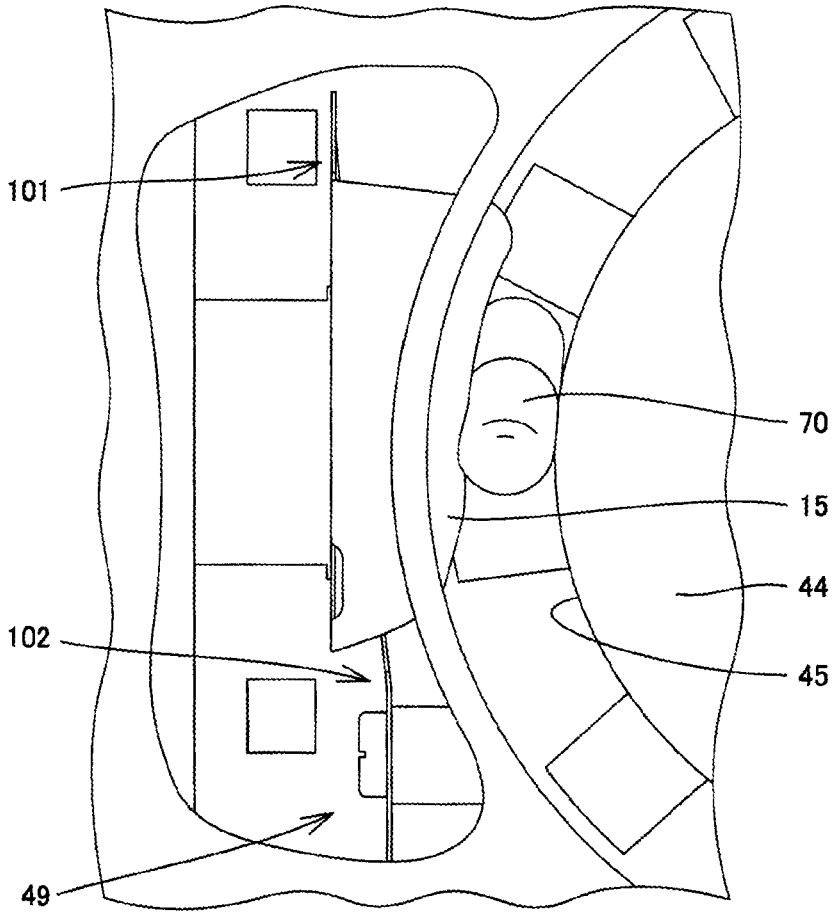
FIG. 18 is a view illustrating the divider plate in a state where the tablet is further transported from the state in FIG. 17.

FIG. 18 is a view illustrating the divider plate in a state where the tablet is further transported from the state in FIG. 17. As illustrated in FIG. 18, when tablet 70 is further transported, tablet 70 is positioned approximately at a middle point between first fulcrum 101 and second fulcrum 102. In this case, cover portion 15 rocks about both first fulcrum 101 and second fulcrum 102, and thereby cover portion 15 moves leftward to a position substantially parallel to the position illustrated in FIG. 16.

Figure 19:
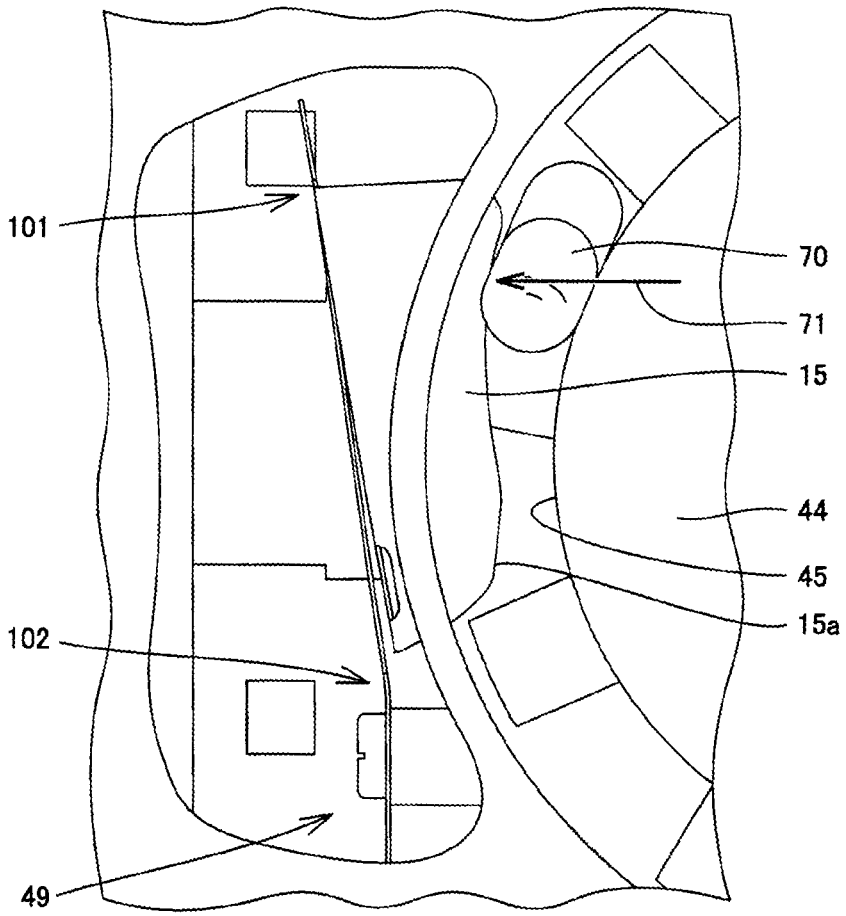
FIG. 19 is a view illustrating the divider plate in a state where the tablet is further transported from the state in FIG. 18.

FIG. 19 is a view illustrating the divider plate in a state where the tablet is further transported from the state in FIG. 18. With reference to FIG. 19, when tablet 70 is further transported, tablet 70 applies a force to a part of cover portion 15 located closer to first fulcrum 101. As a result thereof, cover portion 15 rocks about second fulcrum 102, and thereby, a part 15*a* of cover portion 15 which has no contact with tablet 70 covers groove 45 partially.

Figure 20:
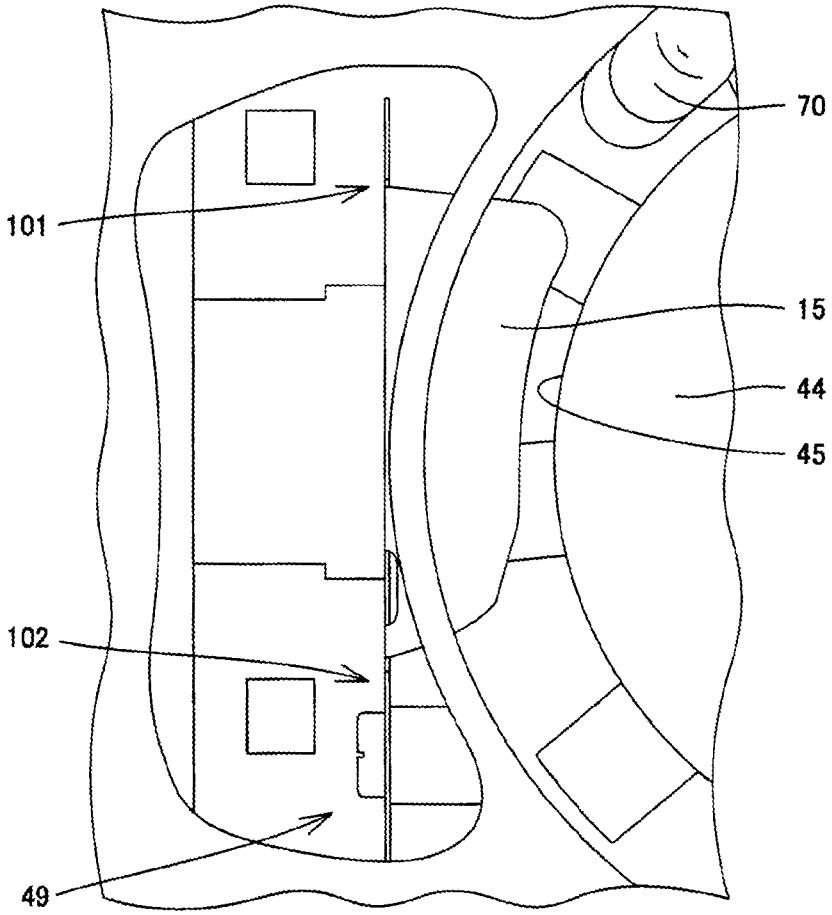

FIG. 20 is view illustrating the divider plate in a state where the tablet has passed through. With reference to FIG. 20, when cover portion 15 and tablet 70 are not in a contacting state, cover portion 15 returns to its original position.

Tablet cassette 40 according to Embodiment 1 is provided with a main body 49 for housing tablet 70, rotor 44 serving as a delivering member which is disposed with groove 45 for receiving tablet 70 housed in main body 49, and divider plate 10 including main body portion 12 and extending portion 13 which serve as an elastic portion mounted to main body 49 and cover portion 15 which is mounted to main body portion 12 and is configured to cover at least a part of an opening portion of groove 45. Dispensing hole 48 is disposed in main body 49 below cover portion 15. When tablet 70 housed in groove 45 is transported below cover portion 15, the tablet falls downward from dispensing hole 48; and tablet 70 with a portion protruding from groove 45 is transported to cover portion 15 to have a contact therewith. Main body portion 12 includes first fulcrum 101 which serves as a fulcrum for a movement in which a part of the cover portion 15, which is in contact with tablet 70 when cover portion 15 and tablet 70 begin to contact each other, moves as a result of being pressed by tablet 70, and second fulcrum 102 which serves as a fulcrum for a movement in which the part of cover portion 15, which is in contact with tablet 70, moves as a result of being pressed by tablet 70 after the movement of main body portion 12 and extending portion 13 supported by the first fulcrum is finished.

First fulcrum 101 is located downstream of the flow of tablet 70, relative to second fulcrum 102. The elastic portion includes main body portion 12 serving as a first piece and extending portion 13 serving as a second piece, in which the first piece and the second piece are configured to extend respectively in a tablet transporting direction, main body portion 12 is mounted to main body 49 at one end, extending portion 13 is mounted to cover portion 15, and main body portion 12 and extending portion 13 are connected to each other at the other end. Divider plate 10 is produced by bending a metal plate.

Figure 21:
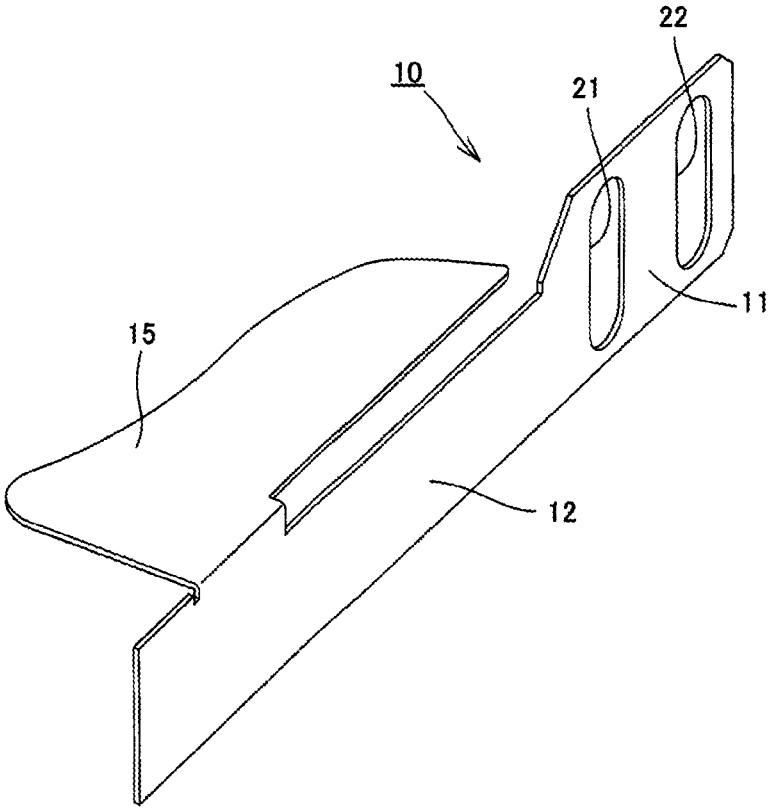
FIG. 21 is a perspective view of a divider plate according to a comparative example.

FIG. 21 is a perspective view of a divider plate according to a comparative example. The divider plate in FIG. 21 differs from the divider plate having the extending portion disposed between main body portion 12 and cover portion 15 according to Embodiment 1 in that cover portion 15 is mounted directly to main body portion 12.

Figure 22:
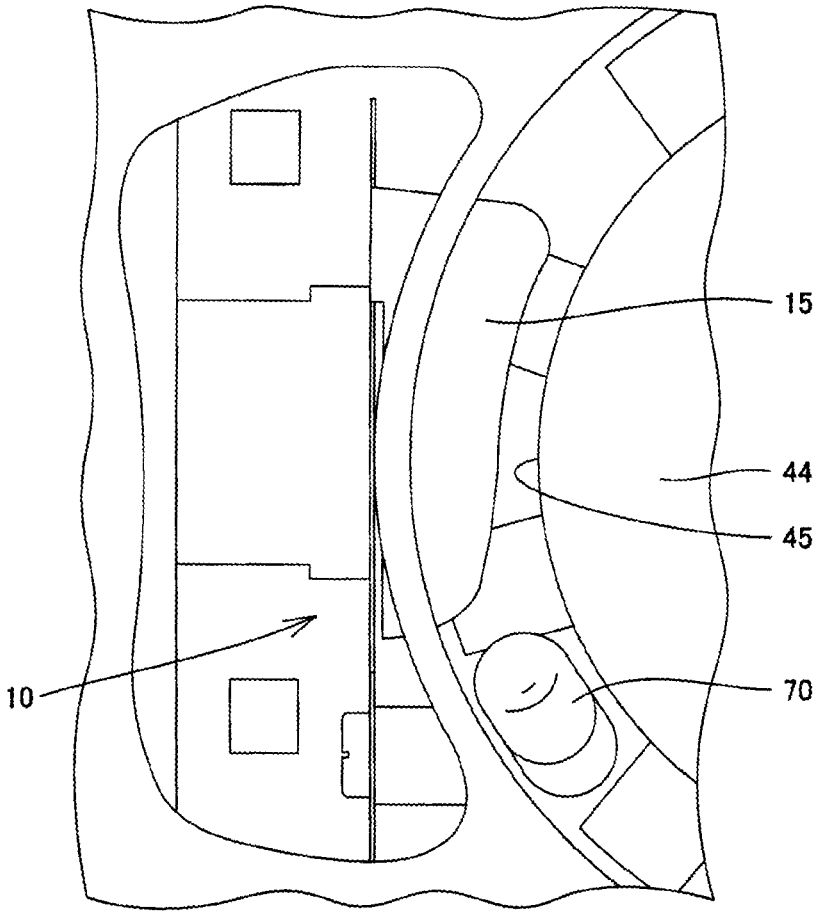
FIG. 22 is a view illustrating a contacting state between the tablet and the divider plate according to the comparative example.

FIG. 22 is a view illustrating a contacting state between the tablet and the divider plate according to the comparative example. With reference to FIG. 22, tablet 70 is transported by rotor 44, and if the position of tablet 70 is inappropriate, tablet 70 will have a contact with cover portion 15.

Figure 23:
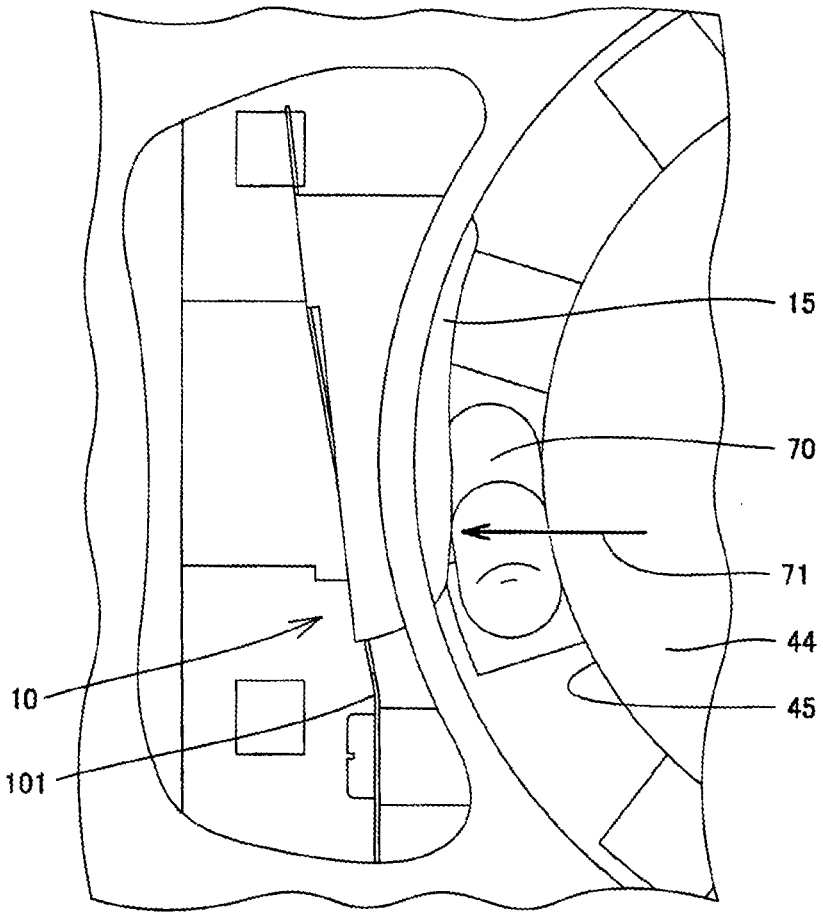
FIG. 23 is a view illustrating the divider plate in a state where the tablet begins to contact the cover portion according to the comparative example.

FIG. 23 is a view illustrating the divider plate in a state where the tablet begins to contact the cover portion according to the comparative example. As illustrated in FIG. 23, when tablet 70 contacts cover portion 15, cover portion 15 rocks greatly about first fulcrum 101.

Figure 24:
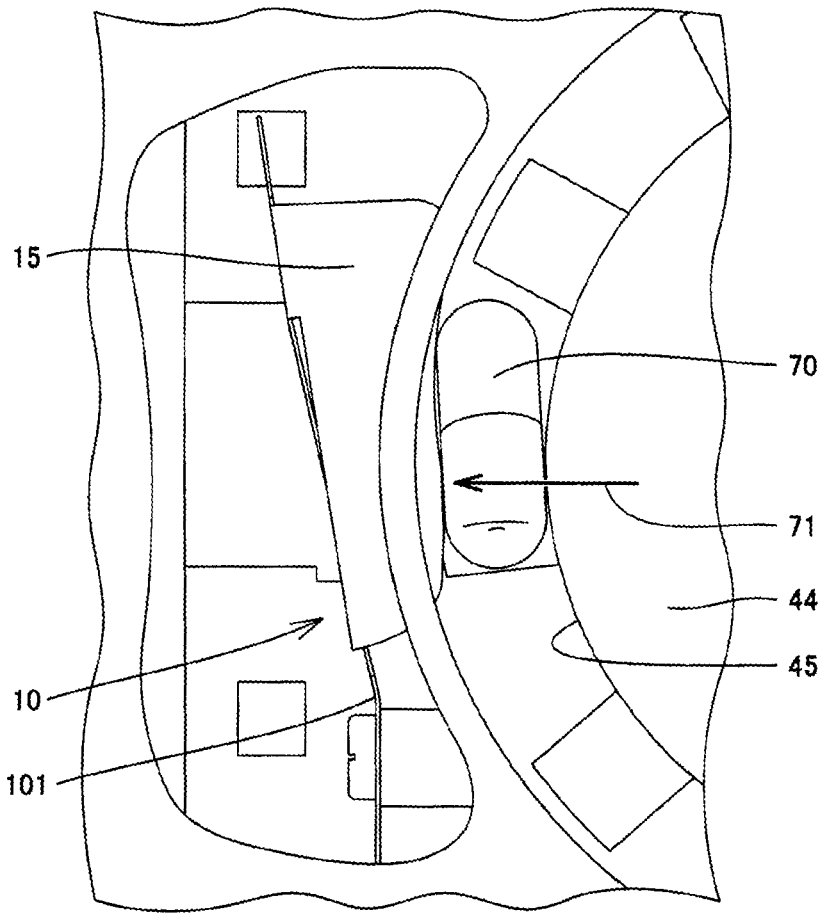
FIG. 24 is a view illustrating the divider plate in a state where the tablet is further transported from the state in FIG. 23 according to the comparative example.

FIG. 24 is a view illustrating the divider plate in a state where the tablet is further transported from the state in FIG. 23 according to the comparative example. With reference to FIG. 24, if tablet 70 is further transported, cover portion 15 rocks more greatly. At this moment, dispensing hole 48 is left substantially uncovered by cover portion 15, which means that dispensing hole 48 is opened. If dispensing hole 48 is opened from the upper side, a tablet will fall into groove 45 and be thereafter dispensed from dispensing hole 48.

In comparison with the comparative example, according to the tablet cassette and the divider plate used in the tablet cassette having the above-mentioned configurations in accordance with Embodiment 1 of the present invention, when tablet 70 and cover portion 15 are in contact with each other, a part of cover portion 15 always covers groove 45 disposed in the rotor. Consequently, dispensing hole 48 is always covered by cover portion 15, which makes it possible to prevent the occurrence of such problem as occurred in the comparative example.

The disposition of first fulcrum 101 and second fulcrum 102 increases the distance from tablet 70 to the fulcrum, and the increased distance between the fulcrum and the action point makes it easy for cover portion 15 to have a rocking movement. Thereby, it is possible to prevent an excessive load from being applied to the tablet.

Further, the excessive load can be prevented from being applied to divider plate 10, and consequently the flexion level of cover portion 15 in the vertical direction can be reduced.

Since the tablet can move smoothly, it is possible to prevent an excessive load from being applied to a driving source for rotating rotor 44 and from being applied to a power transmission member such as gear 44 interposed between rotor 44 and the driving source.

As mentioned above, by disposing the fulcrums at two locations, it is possible to prevent cover portion 15 from moving away in the flow direction of tablets, and thereby cover the dispensing hole with certainty.

In addition, if the bending distance from a portion of the cover covering the dispensing hole to a root portion thereof is increased, it is possible to reduce the flexion level of the cover in the vertical direction.

The material for divider plate 10 is not limited to metals, and it may be resin or rubber.

Embodiment 2

Figure 25:
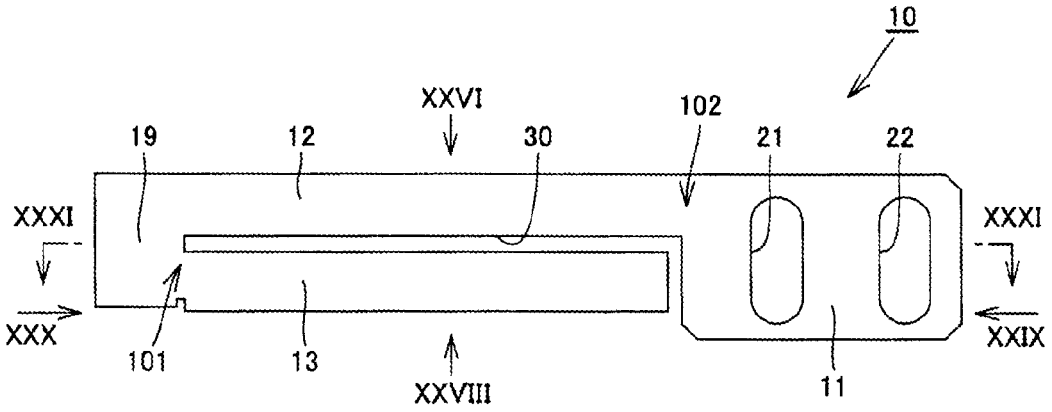
FIG. 25 is a front view of a divider plate used in a tablet cassette according to Embodiment 2 of the present invention.
Figure 26:
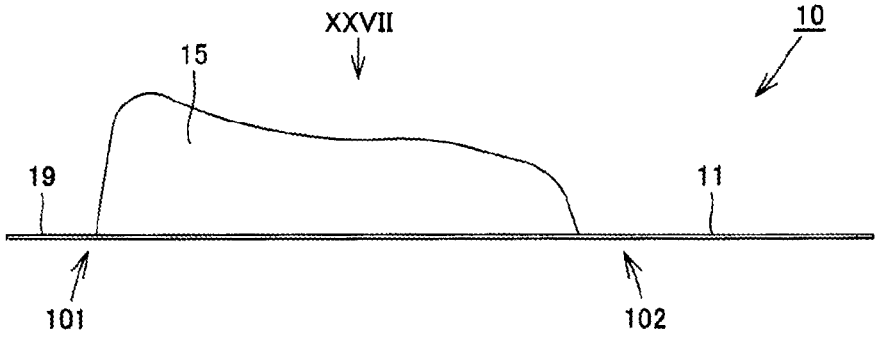
FIG. 26 is a plan view of the divider plate observed from the direction denoted by arrow XXVI in FIG. 25.
Figure 27:
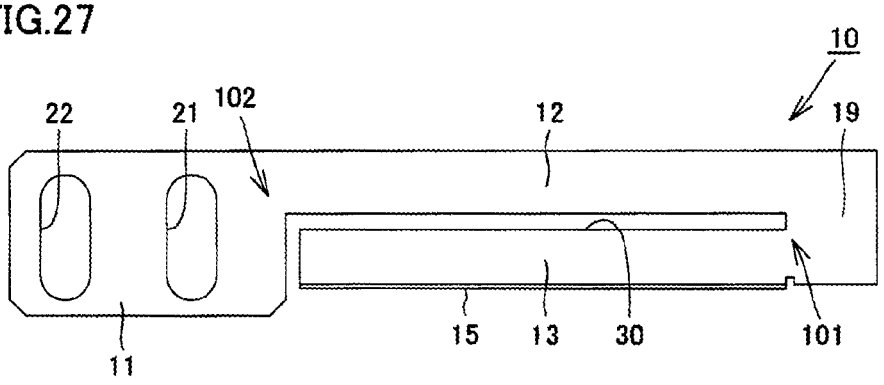
FIG. 27 is a back view of the divider plate observed from the direction denoted by arrow XXVII in FIG. 26.
Figure 28:
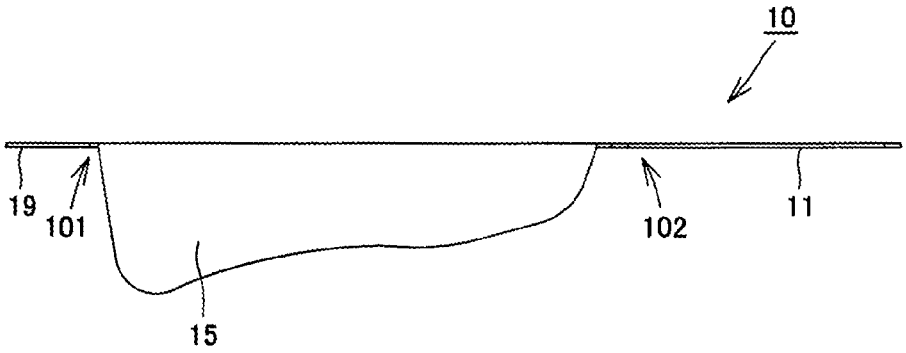
FIG. 28 is a bottom view of the divider plate observed from the direction denoted by arrow XXVIII in FIG. 25.
Figure 29:
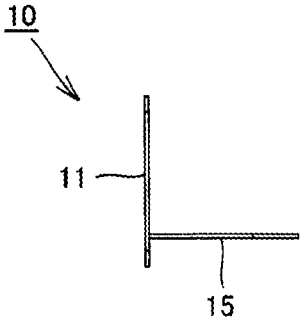
FIG. 29 is a right side view of the divider plate observed from the direction denoted by arrow XXIX in FIG. 25.
Figure 30:
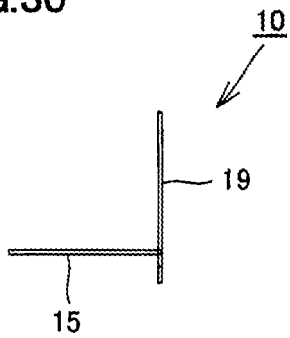
FIG. 30 is a left side view of the divider plate observed from the direction denoted by arrow XXX in FIG. 25.
Figure 31:
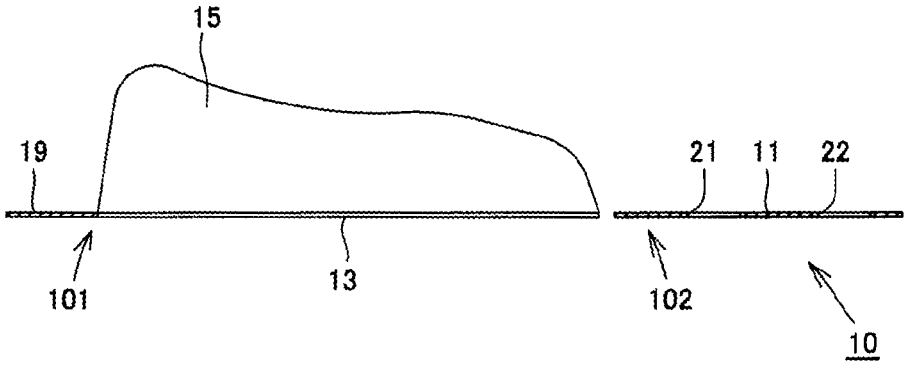
FIG. 31 is a cross sectional view along line XXXI-XXXI in FIG. 25.
Figure 32:
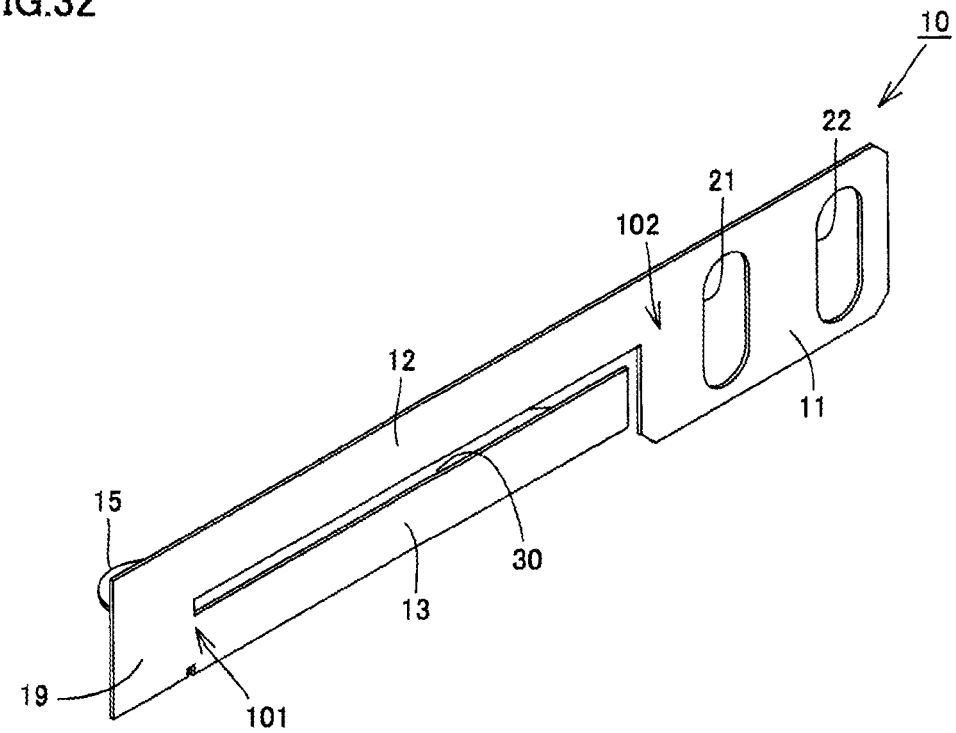
FIG. 32 is a perspective view of the divider plate illustrated in FIG. 25.
Figure 33:
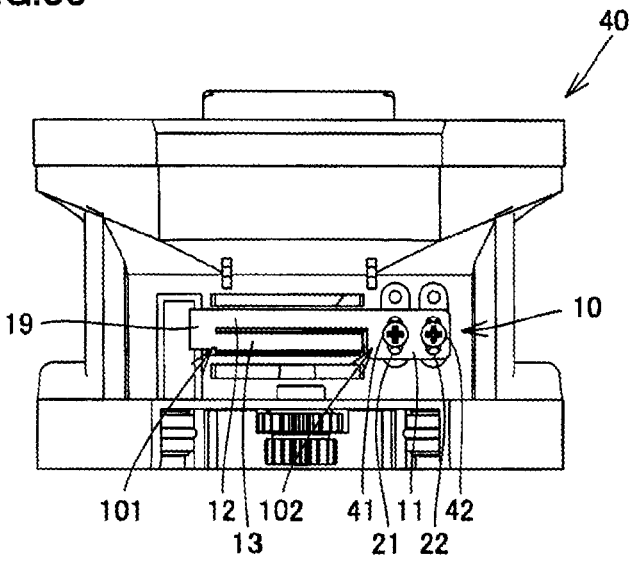
FIG. 33 is a front view of the tablet cassette according to Embodiment 2.
Figure 34:
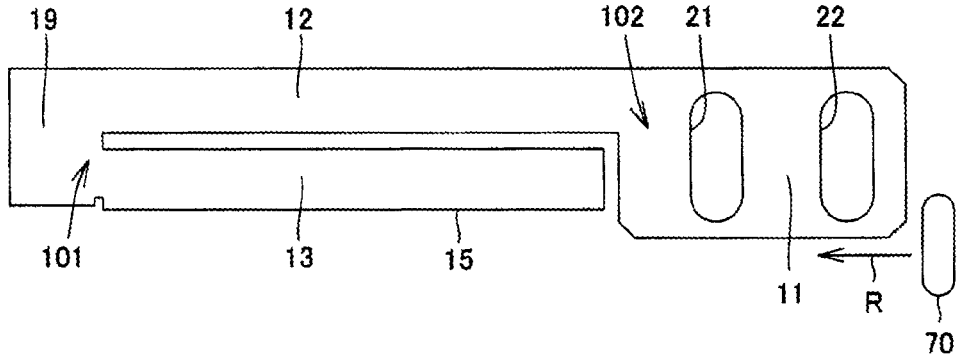
FIG. 34 is a front view illustrating a movement of a tablet moving inside the tablet cassette.
Figure 35:
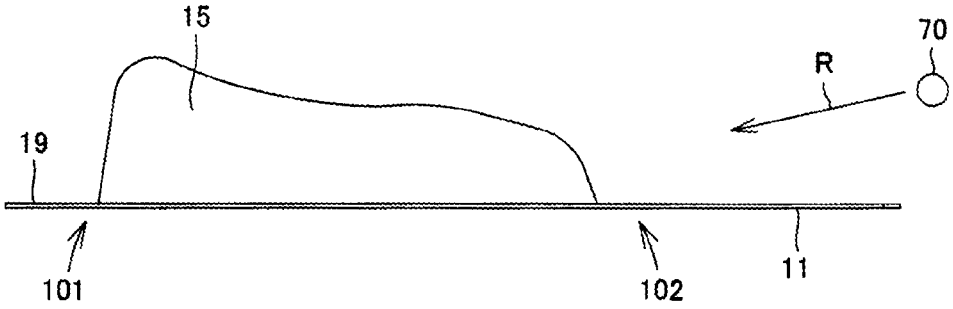
FIG. 35 is a plan view illustrating the movement of the tablet moving inside the tablet cassette.

FIG. 25 is a front view of a divider plate used in a tablet cassette according to Embodiment 2 of the present invention. FIG. 26 is a plan view of the divider plate observed from the direction denoted by arrow XXVI in FIG. 25. FIG. 27 is a back view of the divider plate observed from the direction denoted by arrow XXVII in FIG. 26. FIG. 28 is a bottom view of the divider plate observed from the direction denoted by arrow XXVIII in FIG. 25. FIG. 29 is a right side view of the divider plate observed from the direction denoted by arrow XXIX in FIG. 25. FIG. 30 is a left side view of the divider plate observed from the direction denoted by arrow XXX in FIG. 25. FIG. 31 is a cross sectional view along line XXXI-XXXI in FIG. 25. FIG. 32 is a perspective view of the divider plate illustrated in FIG. 25. FIG. 33 is a front view of the tablet cassette according to Embodiment 2. FIG. 34 is a front view illustrating a movement of a tablet moving inside the tablet cassette. FIG. 35 is a plan view illustrating the movement of the tablet moving inside the tablet cassette.

42 With reference to FIGS. 25 through 35, divider plate 10 used in the tablet cassette according to Embodiment 2 includes a mounting portion 11 mounted in the tablet cassette, a main body portion 12 connected to mounting portion 11, an extending portion 13 which extends in parallel to main body portion 12, a connecting portion 19 which connects main body portion 12 and extending portion 13 together, and a cover portion 15 provided in extending portion 13. Main body portion 12 is disposed at an upper side of the divider plate, and extending portion 13 and cover portion 15 are disposed at a lower side thereof.

Tablet cassette 40 having the configuration mentioned above according to Embodiment 2 can also obtain the same effects as tablet cassette 40 according to Embodiment 1.

Embodiment 3

Figure 36:
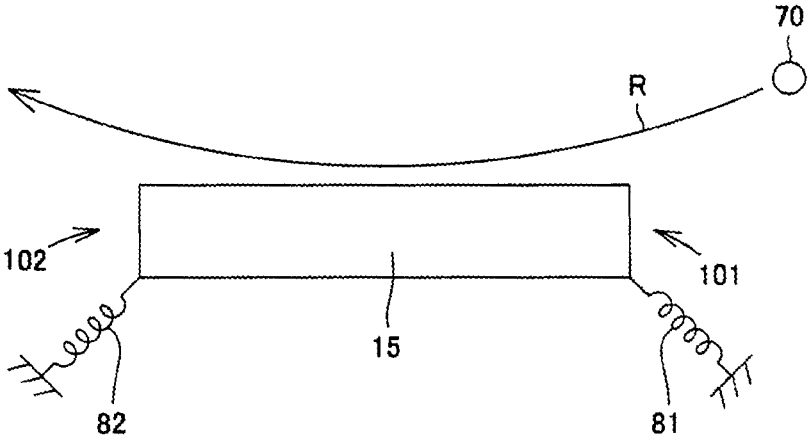
FIG. 36 is a plan view of a tablet cassette according to Embodiment 3 of the present invention.

FIG. 36 is a plan view of a tablet cassette according to Embodiment 3 of the present invention. With reference to FIG. 36, the tablet cassette according to Embodiment 3 differs from the tablet cassette according to Embodiment 1 in that first fulcrum 101 and second fulcrum 102 therein are formed of coil springs 81 and 82, respectively.

REFERENCE SIGNS LIST

10: divider plate; 11: mounting portion; 12: main body portion; 13: extending portion; 14: window; 15: cover portion; 19: connecting portion; 21, 22: hole; 30: slit; 40: tablet cassette; 41, 42: screw; 43: gear; 44: rotor; 45: groove; 48: dispensing hole; 49: main body; 50: cassette base; 60: tablet counter; 70: tablet; 81, 82: coil spring; 101: first fulcrum; 102: second fulcrum

The invention claimed is:

1. A tablet cassette comprising:

a main body for housing a tablet;

a delivering member disposed with a groove having an opening portion for receiving the tablet housed in said main body; and a divider member including an elastic portion mounted to said main body and a cover portion mounted to said elastic portion, said cover portion having a first part and a second part, and configured to be able to cover at least a part of said opening portion of said groove, a hole being opened in said main body below said cover portion, which allows a tablet to fall downward from the hole in said main body when the tablet housed in said groove is transported below said cover portion, a tablet with a portion protruding from said groove being transported to said cover portion to have a contact with said cover portion, and said elastic portion including:

a first fulcrum which serves as a fulcrum for a movement in which said first part of said cover portion, which is in contact with the tablet when said cover portion and the tablet begin to contact each other, moves as a result of being pressed by the tablet, and a second fulcrum which serves as a fulcrum for a movement in which said second part of said cover portion, which is in contact with the tablet, moves as a result of being pressed by the tablet after the movement of said elastic portion supported by said first fulcrum is finished.

2. The tablet cassette according to claim 1, wherein said first fulcrum is located downstream of flow of said tablet, relative to said second fulcrum.

3. The tablet cassette according to claim 2, wherein said elastic portion includes a first piece and a second piece extending respectively in a tablet transporting direction, said first piece is mounted to said main body at a first end of said first piece, said second piece is mounted to said cover portion, and said first piece and said second piece are connected to each other at a second end of said first piece.

4. The tablet cassette according to claim 3, wherein said divider member is produced by bending a metal plate.

* * * * *